US006007378A

United States Patent [19]

Oeth

[11] Patent Number: 6,007,378

[45] **Date of Patent: *Dec. 28, 1999**

[54] LOCKING BOOT SYSTEM

[75] Inventor: John P. Oeth, San Diego, Calif.

[73] Assignee: Qualcomm Incorporated, San Diego, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/850,420

[22] Filed: May 2, 1997

[51] Int. Cl.[6] ..... H01R 13/40

[52] U.S. Cl. ..... 439/588; 439/279; 439/367

[58] Field of Search ..... 439/588, 587, 439/278, 279, 367, 373

[56] References Cited

U.S. PATENT DOCUMENTS

| | | | |
|---|---|---|---|
| 1,965,151 | 7/1934 | Mueller | 439/822 |
| 3,363,222 | 1/1968 | Karol | 439/585 |
| 5,017,160 | 5/1991 | Garcia | 439/588 |
| 5,498,176 | 3/1996 | Hashizawa et al. | 439/585 |

*Primary Examiner*—Neil Abrams
*Assistant Examiner*—T C Patel
*Attorney, Agent, or Firm*—Russell B. Miller; Thomas M. Thibault

[57] ABSTRACT

A system for securing a protective boot over a connector assembly is disclosed. The boot is designed to slide over a pair of mated cable connectors, one connector being panel mounted and the other being cable mounted. The protective boot is located axially along the cable and is positioned over the mated connectors until it is flush against the panel, preventing environmental elements from damaging the connectors. The protective boot is held firmly against the panel by a locking element located on the cable connector which engages a concentric groove located inside of the protective boot. The concentric groove is located at an appropriate distance away from the boot opening such that the locking element engages the groove just as the boot opening becomes flush against the mounting panel.

10 Claims, 7 Drawing Sheets

LOCKING BOOT SYSTEM

BACKGROUND OF THE INVENTION

I. Field of the Invention

This invention relates to electrical connector assemblies. More particularly, the present invention relates to a system for securing a protective boot over a pair of mated connectors located typically in harsh outdoor environments.

II. Description of the Related Art

Panel mounted coaxial connectors are used in outdoor environments in a variety of applications. For example, they are used extensively in the satellite communications field to feed radio-frequency (RF) signals between an antenna and a signal processing unit located remotely from the antenna. Frequently, these panel mounted coaxial connectors are exposed to harsh environmental elements due to their physical proximity to the outdoors. Rain, snow, ice, and dirt can contribute to corrosion and ultimate failure of the electrical connection if such connectors are left exposed.

Several types of devices have been used in order to protect these connectors from the harsh outdoor environment. A variety of rubberized boots have been incorporated into cable assemblies which slide over the cable-mounted connector once it has been coupled to a mating panel-mounted connector. Ideally, the boot slides over the mated connector pair until it rests flush against the panel to which the panel-mounted connector is affixed, forming a seal against harsh environmental conditions. Although this design is suitable in applications where the connector assembly is stationary, problems can occur in mobile applications. For example, mechanical vibration can force the boot to move out of position and away from the panel, exposing the mated connectors to deleterious environmental conditions. In addition, the cable is subject to movement caused by wind or by physical handling of the cable under normal operating conditions. Typical boots found in the art use an interference fit around the mated connectors, where the boot dimensions are slightly smaller than the mated connectors' dimensions in order to inhibit movement along the cable. This feature works well to keep the boot generally in place, but often is not enough to ensure a snug fit against the mating panel upon even minor cable disturbances.

Another method used to protect panel mounted connector assemblies from environmental conditions is the use of resins or compounds which are applied directly to the mated connectors. The putty-like compound is applied directly to the mated connectors and mounting panel so that it completely seals out harmful environmental effects. The compound typically will remain pliable so that it can be removed at any subsequent time for easy access to the connector assembly. The main disadvantage to this method of protection is that the compound is difficult to remove. It can easily contaminate the threads or center conductor of either connector during removal, which can result in poor electrical contact when the cable assembly is re-assembled.

What is needed is a protective connector covering which will remain in constant contact with the mounting panel in order to seal out harmful environmental elements. The protective covering should be easy to install and remove, without resorting to compounds which can contaminate the connectors.

SUMMARY OF THE INVENTION

A system is disclosed which provides a locking protective covering to a panel-mounted connector pair. The system comprises a flexible protective boot which fits over the panel-mounted connector pair and is secured by a locking element located on the cable-mounted connector near the connector/cable interface. In an alternative embodiment, the locking element may be located on the cable itself, near a connector/cable interface.

In the preferred embodiment, the locking element is in the shape of a toroid, or ring, located on the cable-mounted connector at the connector/cable interface. Alternatively, the locking mechanism can be a concentric ridge, groove, lip, flare, rib, or a series of tabs spatially located around the perimeter of the connector/cable interface. The locking feature secures the protective boot firmly in position against the mounting panel, even when the cable is subjected to movement due to mechanical vibration, for example.

The protective boot is designed with a concentric groove on its inner surface which accepts a locking element located on the cable-mounted connector. The locking element is rigidly held in place with respect to the mounting panel once the cable-mounted connector is mated with the panel-mounted connector. The protective boot is located as part of the cable assembly and is typically installed on the cable prior to installation of the cable connector.

During installation, the protective boot is positioned along the cable away from the connectors. After the cable-mounted connector has been mated to the panel-mounted connector, the protective boot is brought forward, sliding over the connector assembly until it is flush against the mounting panel. At the point when the protective boot is flush against the mounting panel, the locking element engages the concentric groove inside the protective boot so that it is held firmly in place. The protective boot will remain in contact with the mounting panel regardless of cable movement or vibration. The boot can be disengaged by applying a force along the cable axis which is great enough to overcome the mechanical resistance of the locking element/concentric groove combination.

BRIEF DESCRIPTION OF THE DRAWINGS

The features, objects, and advantages of the present invention will become more apparent from the detailed description set forth below when taken in conjunction with the drawings in which like reference characters identify correspondingly throughout and wherein.

DETAILED DESCRIPTION OF THE PREFERRED EMBODIMENTS

Figure 1:
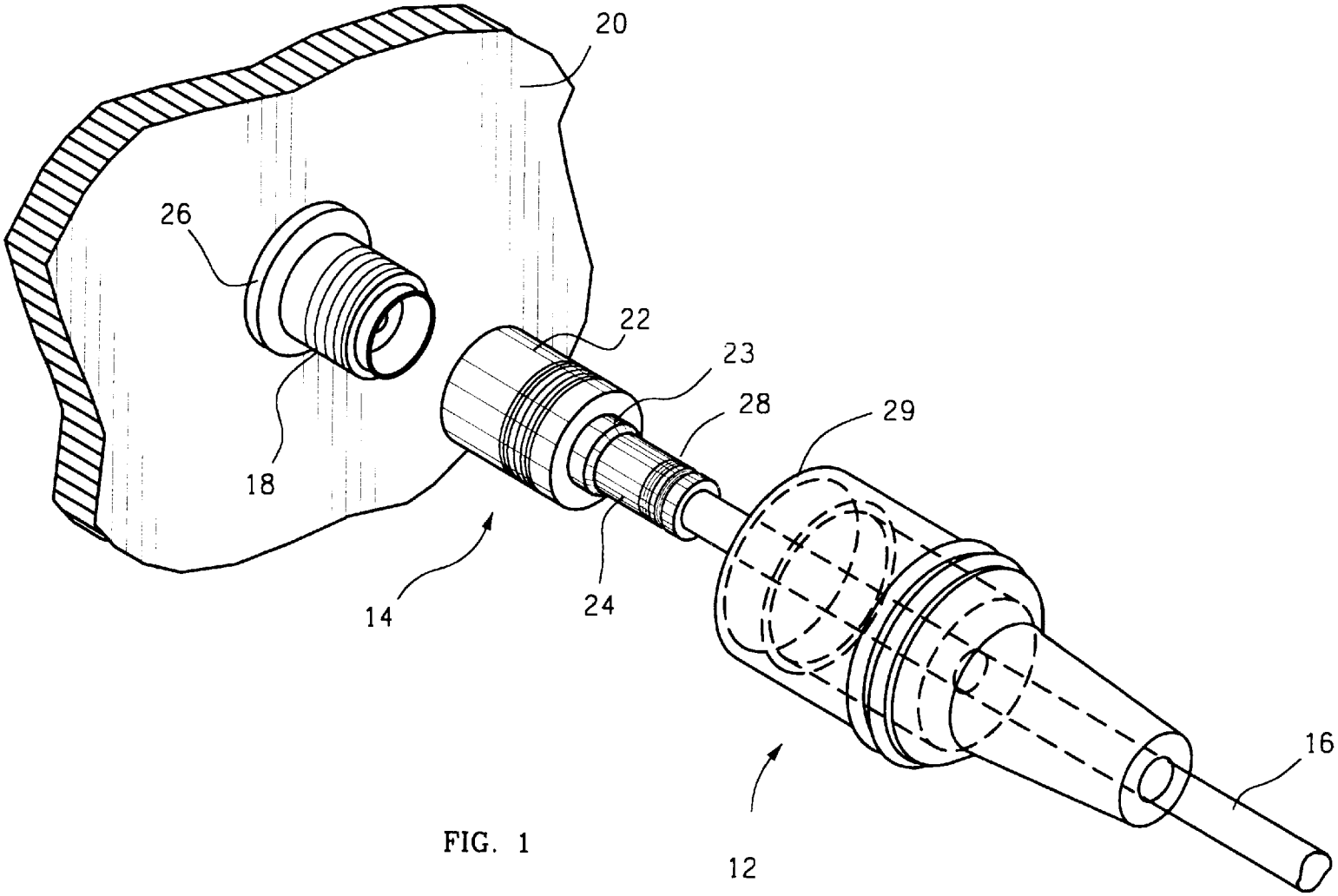
FIG. 1 is an exploded view of a protective boot system.

The present invention is a system for protecting a cable panel-mounted connector assembly from harmful environmental conditions using a protective boot which locks in place with respect to the connector assembly. Referring now to the drawings, FIG. 1 illustrates a first exemplary embodiment of a protective boot system 10 of the present invention. Protective boot system 10 is comprised of protective boot 12 and cable connector 14 mounted to coaxial cable 16. Cable connector 14 mates with panel-mounted connector 18 which is affixed to panel 20. Panel 20 is a surface on which panel-mounted connector 18 is installed and is typically a housing designed to accommodate electrical and/or mechanical components. Sealing element 26 is positioned concentrically around panel mounted connector 18 and in contact with panel 20. Sealing element 26 is typically known in the art as a flexible O-ring, although any kind of flexible, annular seal known in the art may be substituted. After cable connector 14 has been mated with panel mounted connector 18, protective boot 12 slides forward along cable 16 until opening 29 is flush against panel 20. At this position, protective boot 12 is held in place against panel 20 by a fastening means, shown as locking element 28, that will be discussed in greater detail below. The protective boot seals out harsh environmental elements from the mated connectors which can damage them over time or interfere with their operation and use.

Cable connector 14 is comprised of body 22, ferrule 24, collar 23, locking element 28, and a center conductor, not shown. Although locking system 10 of the present invention is shown in the exemplary embodiment as a system employing a coaxial cable and connector, it should be understood that the present invention may be implemented using other types of cables and connectors as well, including a TNC, HN, SMA, SMB, or any circular shaped connector known in the art. Additionally, the locking system of the present invention can be used with other geometrically shaped connectors, for example a rectangular or square connector design, provided that the protective boot is shaped accordingly. Body 22 has threads inscribed on its interior walls (not shown) which allows it to be mated to panel-mounted connector 18. Panel-mounted connector 18 has threads located on its exterior surface which mate with the threads on body 22 interior. Body 22 mates to panel-mounted connector 18 by abutting against connector 18 and then rotating body 22 in a clockwise or counter-clockwise direction, depending on the thread orientation of the connector pair. Cable connector 14 is drawn down upon panel mounted connector 18 by the rotation. It will be readily understood by those skilled in the art that alternative methods of securing cable connector 14 to panel-mounted connector 18 may be used instead of the interlocking threads described herein. Body 22 is drawn towards panel 20 until it engages sealing element 26, forming a barrier against harmful environmental elements so that the center conductors and interior portions of both connectors are protected.

Figure 8:
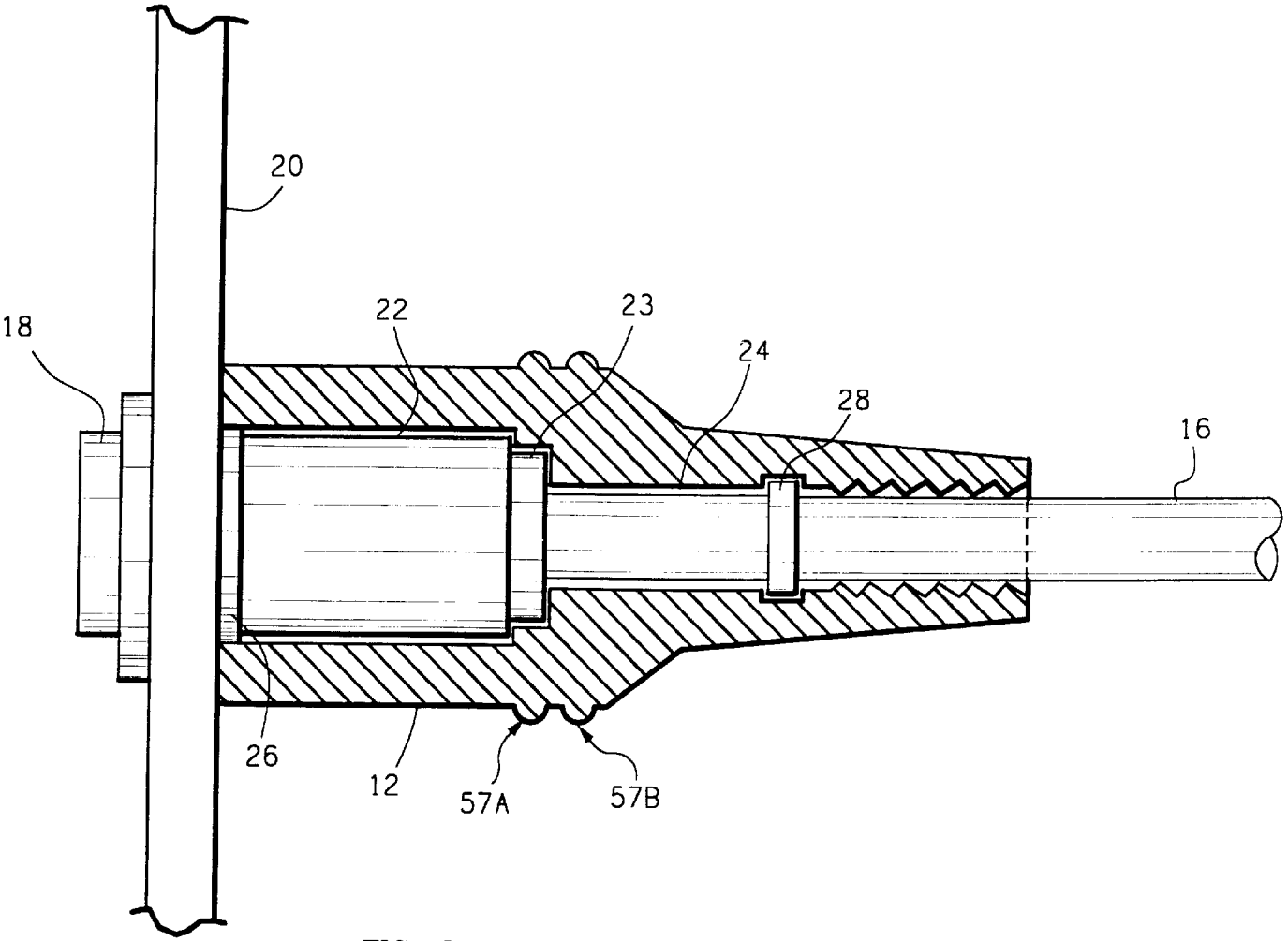

After the two connectors have been mated, protective boot 12 is used to cover the mated connectors and protect against environmental elements such as moisture and dirt. Protective boot 12 is mounted axially along coaxial cable 16 and is able to slide along the length of coaxial cable 16 until opening 29 is flush against panel 20. At this point, locking element 28 located on ferrule 24 engages a concentric groove located inside protective boot 12 which secures it against panel 20. Protective boot 12 remains in place even in environments where mechanical vibration is predominant, such as in mobile applications on-board commercial trucks, for example. Those skilled in the art will readily understand that protective boot 12 is held in place by the engagement of the locking element to the concentric groove. Protective boot 12 will remain flush against panel 20 even if cable 16 is moved due to wind or by physical handling during routine activity FIG. 8 illustrates a cutaway view of the assembled protective boot system.

Figure 2:
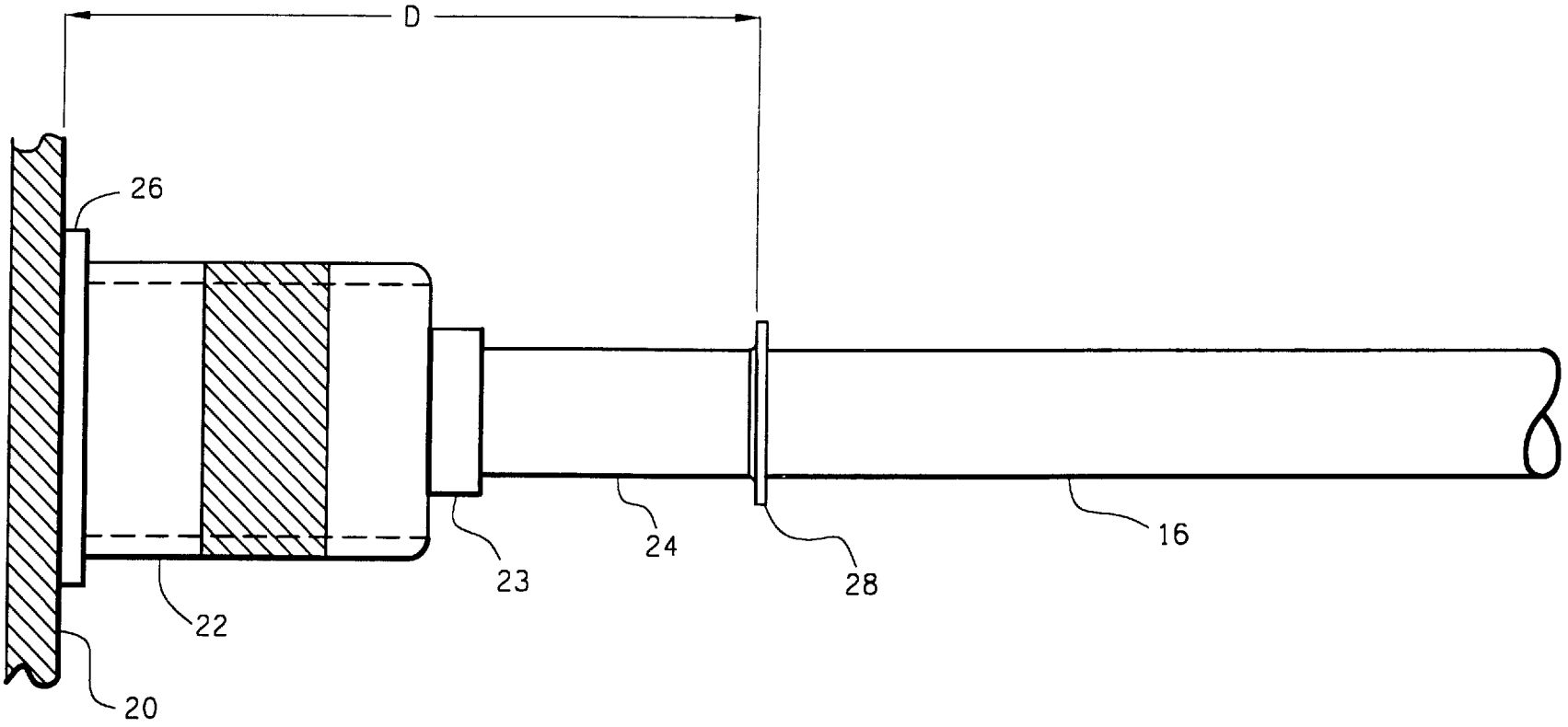
FIG. 2 is an illustration of a cable and connector in accordance with the exemplary embodiment of the present invention.
Figure 3A:
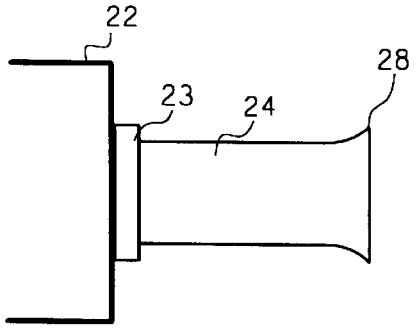
FIGS. 3*a,* 3*b,* 3*c,* and 3*d* are illustrations of alternative embodiments of a locking element as used in the present invention.
Figure 3B:
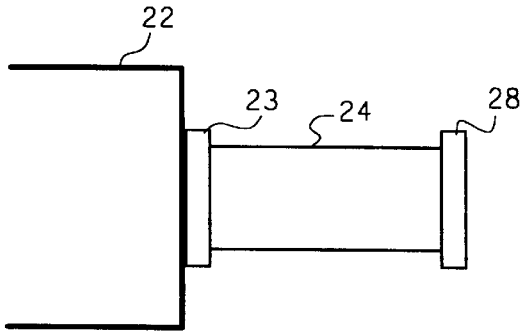
FIGS. 3*e* and 3*f* illustrate a cross section of a ferrule and a locking element as used in the present invention.
Figure 3C:
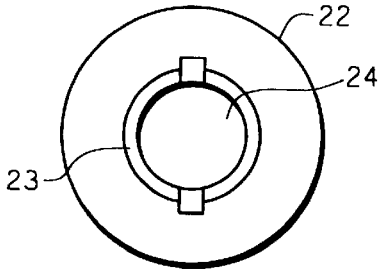
Figure 3D:
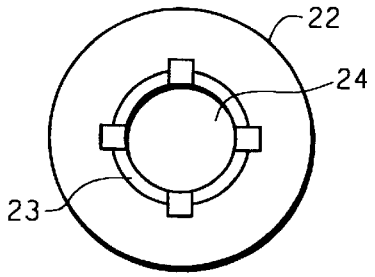
Figure 3E:
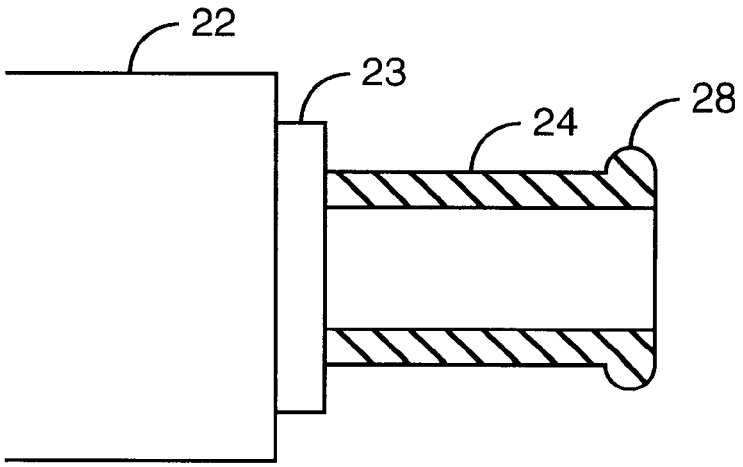
Figure 3F:
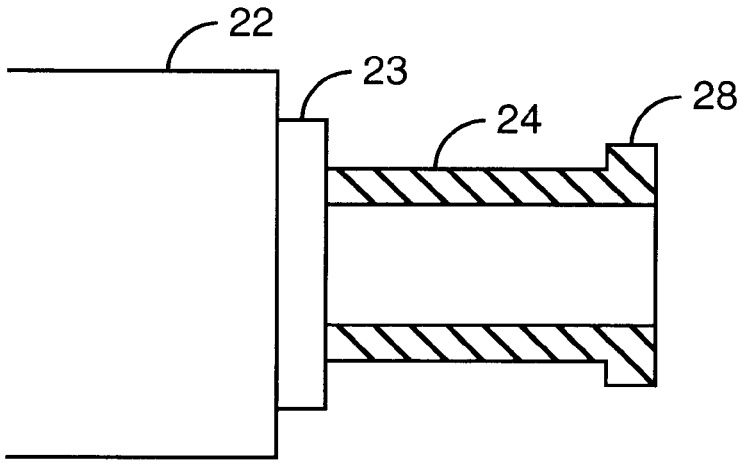

FIG. 2 is an illustration of coaxial cable 16 and cable connector 14. Cable connector 14 is comprised of body 22, collar 23, ferrule 24, and locking element 28. Body 22 is free to rotate about ferrule 24, collar 23, and coaxial cable 16 and has internal threads (not shown) that are used to mate with external threads located on panel mounted connector 18. Ferrule 24 is used to provide strain relief to coaxial cable 16 and to mechanically couple coaxial cable 16 to cable connector 14. Ferrule 24 is typically installed onto coaxial cable 16 by crimping, however it should be understood that other methods well known in the art may be used to secure ferrule 24 in place. For example, ferrule 24 may be mounted directly to collar 23 without being crimped to coaxial cable 16. In the exemplary embodiment, the end of ferrule 24 located furthest from body 22 is formed into a concentric ring, shown as locking element 28 in FIG. 2. In addition, locking element 28 may be formed into one of any number of shapes, including a flared end (FIG. 3*a*), a squared ridge (FIG. 3*b*), or a series of tabs ranging in number from two tabs (FIG. 3*c*) to four tabs (FIG. 3*d*) or more (not shown), FIGS. 3*c* and 3*d* shown as viewing the assemblies along a center axis of coaxial cable 16. Other methods of forming locking element 28 may be used as well, such as positioning a pre-formed element on the end of ferrule 24. The element may have a semi-circular (FIG. 3*e*), square (FIG. 3*f*), or any other cross section as long as it is able to lock into the concentric groove located inside protective boot 12.

Locking element 28 is positioned a predetermined distance from panel 20, shown as distance d, after cable connector 14 has been secured onto panel-mounted connector 18. Locking element 28 is used to secure protective boot 12 into place by engaging a concentric groove located inside protective boot 12. The concentric groove inside of protective boot 12 is located at approximately the same distance d from panel 20 after being installed over the mated cable connectors. Locking element 28 engages the concentric groove just as opening 29 of protective boot 12 contacts panel 20, forming an environmental seal. Protective boot 12 is held firmly in place against panel 20 by the engagement of locking element 28 to the concentric groove. Those skilled in the art will recognize that the precise location of the concentric groove is affected by the compression of sealing element 26, which affect the distance that body 22, and hence locking element 28, is located away from panel 20.

Figure 4:
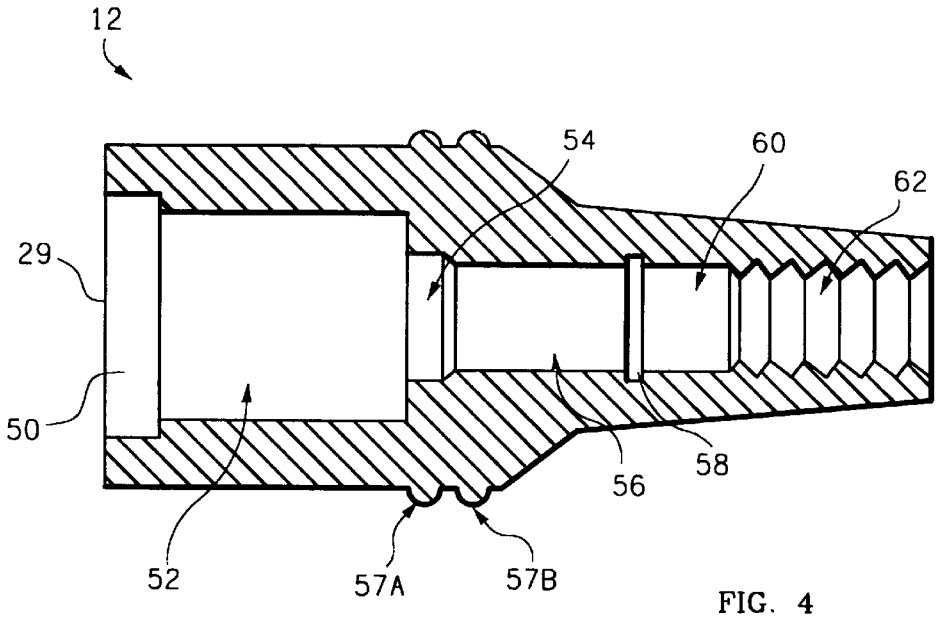
FIG. 4 is a cross sectional view of the protective boot in accordance with an exemplary embodiment of the present invention.

FIG. 4 is a cross sectional view of protective boot 12 in the exemplary embodiment. Protective boot 12 is made of any flexible material such as rubber, silicon rubber, polyurethane or any similar material known in the art to be resistant to harmful environmental elements. In the exemplary embodiment, protective boot 12 is made of UV resistant nitrile.

Protective boot 12 is comprised of a series of concentric hollow regions along the center axis. Each region is tailored to allow cable connector 14 and coaxial cable 16 to fit easily inside protective boot 12 upon installation. Regions 50, 52, 54, and 56 accommodate sealing element 26, body 22, collar 23, and ferrule 26, respectively. The diameter of region 56 is generally slightly larger than the diameter of ferrule 24 leaving an air gap therebetween. This allows for easy removal of protective boot 12 by applying a force to external concentric rings 57*a* and 57*b* perpendicular to the cable axis and then applying a force to protective boot 12 away from panel 20 along the coaxial cable axis.

Region 58 represents concentric groove 64 which allows locking element 28 of ferrule 24 to engage upon installation. Locking element 28 fits snugly into concentric groove 64 so that opening 29 on protective boot 12 is held securely flush against panel 20. As shown in FIG. 2, concentric groove 64 is located at approximately the same distance d from panel 20 after protective boot 12 is installed over the mated cable connectors and is flush against panel 20. The precise location of the concentric groove may be determined by additional factors, such as the amount of compression of sealing element 26. It will be appreciated by those skilled in the art how to determine the precise location of concentric groove 64 so as to form a sealing fit of opening 29 against panel 20. For example, concentric groove 64 may be located so as to provide a compression fit of protective boot 12 against panel 20.

Protective boot 12 is further comprised of region 60 which accommodates coaxial cable 16 and region 62, which represents a ribbed portion of protective boot 12 which grips coaxial cable 16 and provides additional support, added resistance against boot movement, and an environmental seal against water, ice, and dirt.

In the exemplary embodiment, protective boot 12 is designed to fit over electrical connectors, therefore it is dimensioned in accordance with the size of such connectors. For example, in a typical application, protective boot 12 may measure two inches in length and approximately one inch in diameter at its largest point. The thickness of the flexible material could range from one sixteenth of an inch to five eighths inch depending on the point of interest along the length of protective boot 12. The width of region 58 representing concentric groove 64 is generally small: on the order of 0.025 inches wide.

Figure 5:
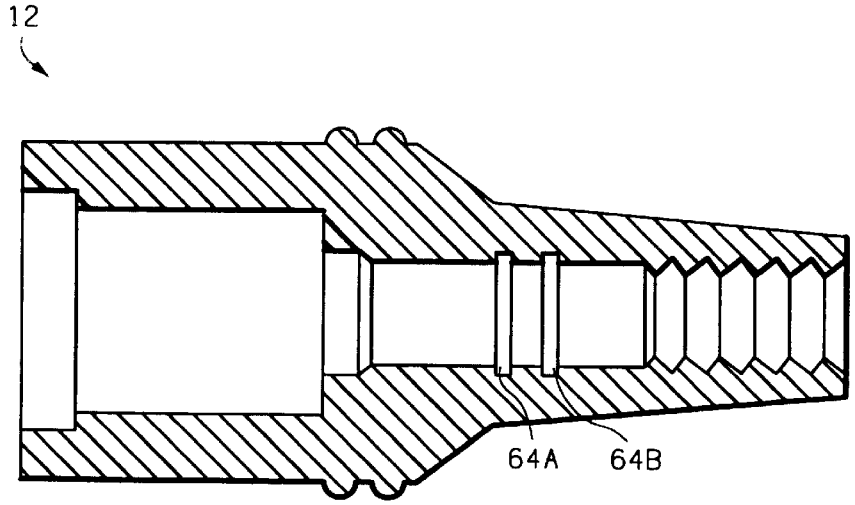
FIG. 5 is a cross sectional view of the protective boot in an alternative embodiment of the present invention.

FIG. 5 illustrates an alternative embodiment of protective boot 12. In this embodiment, more than one concentric groove 64 is located inside protective boot 12. For purposes of discussion with respect to FIG. 5, one concentric groove will be designated as concentric groove 64*a* and a second concentric groove will be designated as concentric groove 64*b*. This design allows for cable connectors having locking element 28 spaced at different distances from panel 20 to use the same protective boot.

For example, if one type of cable connector has locking element 28 located a distance d from panel 20 and a second cable connector has locking element 28 located a distance y from panel 20, a single type of protective boot 12 could be used in either situation. In the first case, locking element 28 would engage protective boot 12 in first concentric groove 64*a* located a distance d from mounting panel 20, plus a small distance to account for the compression of sealing element 26.

In the second case, locking element 28 would engage second concentric groove 64*b* after sliding past first concentric groove 64*a*, located a distance y from mounting panel 20, plus a small distance to account for the compression of sealing element 26. Although only two concentric grooves are shown in FIG. 5, it should be understood that multiple grooves could be located within protective boot 12 to enable it to be used in situations where multiple cable connectors have locking elements located at different distances away from panel 20.

Figure 6:
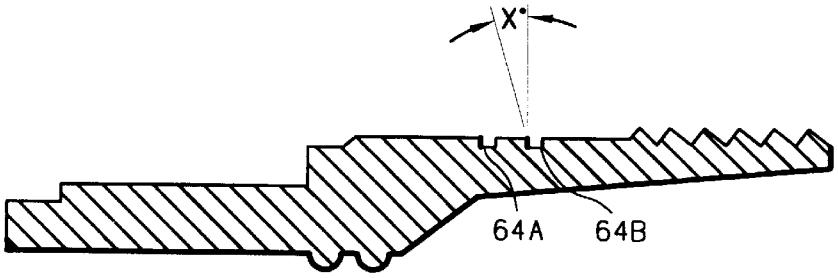
FIG. 6 is a second cross sectional view of the protective boot of FIG. 5.

FIG. 6 is another cross sectional view of protective boot 12 as described in an alternative embodiment. In particular, it details concentric groove 64. Concentric groove 64 may have several kinds of cross-sections, depending on which type of materials protective boot 12 and locking element 28 are made of. In addition, the cross-section of concentric groove 64 is typically dependent on the cross-section of locking element 28. For example, if locking element 28 has a square cross section, the most probable cross section of concentric groove 64 would be square as well.

If protective boot 12 is made of a relatively soft material, the cross-section of concentric groove 64*a* can be cut so as to form sides perpendicular to the center axis of protective boot 12. This allows locking element 28 to remain engaged with concentric groove 64*a* with less likelihood of dislodgment during vibration or other movement. On the other hand, if protective boot 12 is made of a relatively hard material, the leading edge of concentric groove 64*b* can be cut at an angle to allow easier removal of the boot upon intentional disengagement without sacrificing the integrity of the locking function during normal operation.

Figure 7:
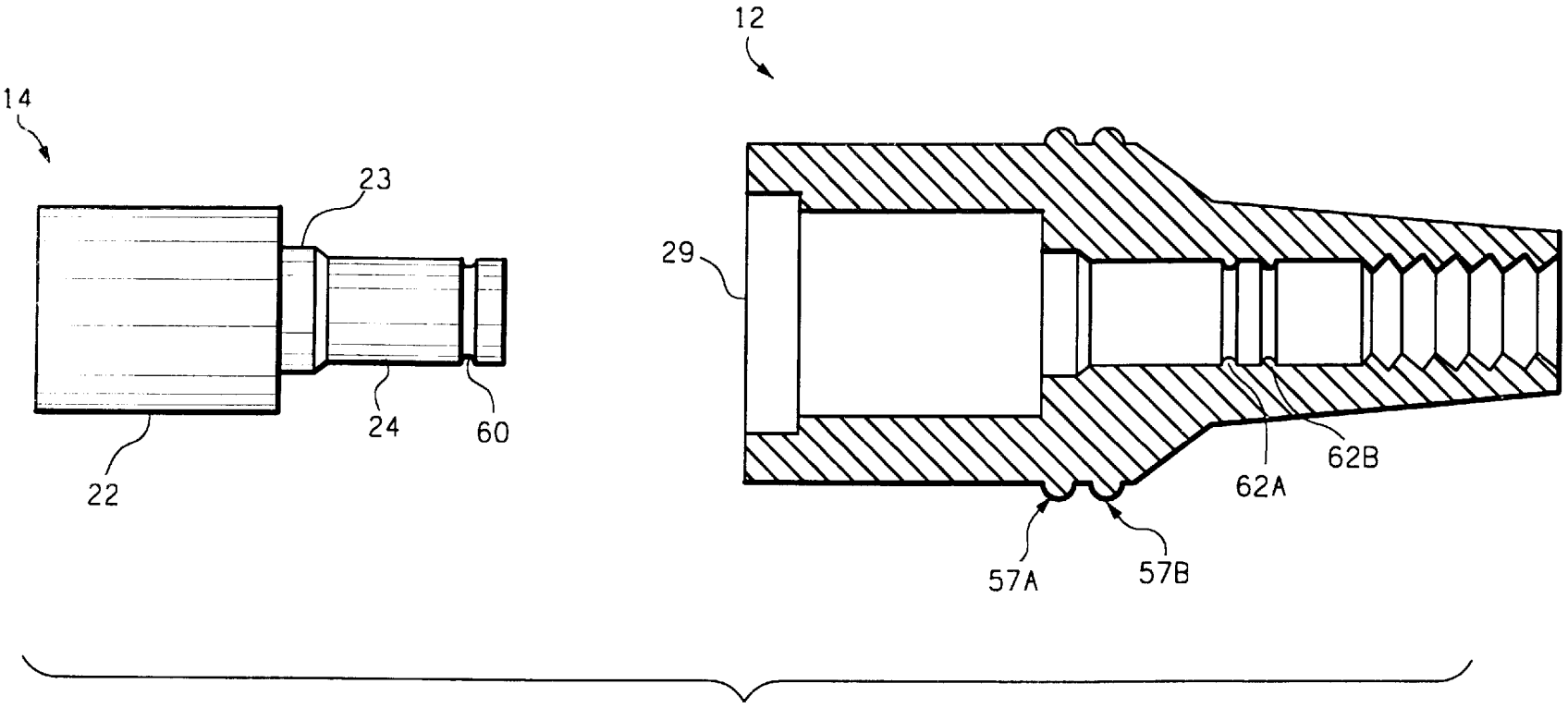
FIG. 7 is a cross sectional illustration of the protective boot and cable connector in a second alternative embodiment and FIG. 8 illustrates a cutaway view of the assembled protective boot system.

FIG. 7 is an cross sectional illustration of protective boot 12 and cable connector 14 shown in a second alternative embodiment. As before, cable connector 14 is comprised of body 22, collar 23, and ferrule 24. However, no locking element is necessary on ferrule 24 in this embodiment. Instead, a concentric groove 60 is located along ferrule 14 which receives either locking element 62*a* or locking element 62*b* located within protective boot 12. Alternatively, the concentric groove may be located on coaxial cable 16 itself, without the need for ferrule 24 for purposes of the present invention. For example, a concentric groove could be inscribed on the insulating layer of coaxial cable 16 for engaging a locking element located within protective boot 12.

Cable connector 14 mounts to panel mounted connector 18 as before, then protective boot 12 is positioned over cable connector 14 until opening 29 is flush against panel 20. At this point, concentric ring 62*a* inside protective boot 12 engages concentric groove 60 on ferrule 24 and secures protective boot 12 firmly in place against panel 20. It should be understood that concentric rings 62*a* and 62*b* may be formed either by installation of a concentric structure mounted inside protective boot 12, or as an integral part of protective boot 12 itself. Protective boot 12 can be removed as explained above by applying a longitudinal force at external concentric rings 57*a* and 57*b* and pulling it axially along coaxial cable 16 away from panel 20.

Although protective boot 12 is shown as having two locking elements 62*a* and 62*b*, it should be understood that a single locking element could be used or more than two could be used to accommodate concentric grooves located at different positions in relation to panel 20 upon installation. A single protective boot with multiple locking elements could then accommodate a number of different connectors.

The previous description of the preferred embodiments is provided to enable any person skilled in the art to make or use the present invention. The various modifications to these embodiments will be readily apparent to those skilled in the art, and the generic principles defined herein may be applied to other embodiments without the use of the inventive faculty. Thus, the present invention is not intended to be limited to the embodiments shown herein but is to be accorded the widest scope consistent with the principles and novel features disclosed herein.

We claim:

1. Apparatus for protecting a pair of mated connectors, one of said mated connectors being a panel mounted connector mounted to a panel and the other connector being a cable mounted connector, said apparatus comprising:

a cable mounted connector engaged with said panel mounted connector, said cable mounted connector comprising:

a connector body;

a ferrule proximate to said connector body and attached thereto;

a locking element concentrically located on said ferrule, said locking element located at a first predetermined distance from an opening on said cable mounted connector;

a protective boot installed over said cable mounted connector and forming a compression fit against said panel; and at least one concentric groove located on an inner surface of said protective boot, said concentric groove for engaging said locking element, said concentric groove located at a second predetermined distance from an opening on said protective boot, said second predetermined distance being greater than said first predetermined distance such that said protective boot is compressed against said panel upon said locking element engaging said concentric groove.

2. Apparatus of claim 1 wherein said locking element is constructed by forming the end of said ferrule.

3. Apparatus of claim 1 wherein said locking element comprises a plurality of tabs concentrically positioned around said ferrule.

4. Apparatus of claim 1 wherein said locking element is constructed by positioning a pre-formed locking element concentrically around said ferrule.

5. Apparatus of claim 4 wherein said locking element comprises a half-circle cross-section.

6. Apparatus of claim 4 wherein said locking element comprises a square cross-section.

7. Apparatus of claim 1 wherein said at least one concentric groove comprises sides perpendicular to a center axis of said protective boot.

8. Apparatus of claim 1 wherein said at least one concentric groove comprises one perpendicular side and one angular side with respect to a center axis of said protective boot.

9. Apparatus of claim 1 wherein said protective boot comprises:

a series of hollow concentric regions designed to accommodate said cable mounted connector, including a connector body, a collar, said ferrule, and said locking element.

10. Apparatus of claim 9 wherein said protective boot further comprises a series of hollow concentric ribs designed to grip a cable mounted to said cable mounted connector.

* * * * *